US007913956B2

(12) United States Patent
Mugg

(10) Patent No.: US 7,913,956 B2
(45) Date of Patent: Mar. 29, 2011

(54) MECHANISM FOR OPERATING SWITCH POINTS

(75) Inventor: Philippe Mugg, Haguenau (FR)

(73) Assignee: Vossloh Cogifer, Rueil Malmaison (FR)

( * ) Notice: Subject to any disclaimer, the term of this patent is extended or adjusted under 35 U.S.C. 154(b) by 0 days.

(21) Appl. No.: 12/310,961

(22) PCT Filed: Sep. 13, 2007

(86) PCT No.: PCT/FR2007/001496

§ 371 (c)(1),
(2), (4) Date: Mar. 13, 2009

(87) PCT Pub. No.: WO2008/031956

PCT Pub. Date: Mar. 20, 2008

(65) Prior Publication Data

US 2009/0242706 A1 Oct. 1, 2009

(30) Foreign Application Priority Data

Sep. 14, 2006 (FR) ..... 06 53738

(51) Int. Cl.
*B61L 5/00* (2006.01)

(52) U.S. Cl. ..... 246/393; 246/435 R

(58) Field of Classification Search ..... 246/393–405
See application file for complete search history.

(56) References Cited

U.S. PATENT DOCUMENTS

| | | | | |
|---|---|---|---|---|
| 2,098,831 | A * | 11/1937 | McGowan | 246/291 |
| 2,656,456 | A * | 10/1953 | Wallace | 246/240 |
| 3,127,138 | A * | 3/1964 | Wilson et al. | 246/393 |
| 3,136,509 | A * | 6/1964 | Magnus | 246/393 |
| 3,355,585 | A * | 11/1967 | Schwab | 246/393 |
| 4,213,588 | A * | 7/1980 | Bowles | 246/259 |
| 5,052,642 | A * | 10/1991 | Peters | 246/393 |
| 5,531,408 | A * | 7/1996 | Wechselberger | 246/257 |
| 6,168,120 | B1 * | 1/2001 | Pease | 246/405 |
| 6,454,221 | B1 * | 9/2002 | Bonfigli | 246/415 R |
| 2006/0208137 | A1 * | 9/2006 | Scheer | 246/393 |
| 2009/0242706 | A1 * | 10/2009 | Mugg | 246/435 R |

FOREIGN PATENT DOCUMENTS

| | | |
|---|---|---|
| BE | 333459 A | 5/1925 |
| EP | 0769439 A1 | 4/1997 |

* cited by examiner

*Primary Examiner* — S. Joseph Morano
*Assistant Examiner* — Jason C Smith
(74) *Attorney, Agent, or Firm* — The Watson IP Group, PLC; Jovan N. Jovanovic; Vladan M. Vasiljevic

(57) ABSTRACT

The subject of the present invention is a mechanism for operating sets of switch points, comprising an actuator control assembly (1) actuating two points operating half-bars (2), each connected to one point blade (switch rail), by a point-setting device (3) and by a manual control (4) connected in the actuator control assembly (1). The mechanism is one wherein actuation of the two points-operating half bars (2) by the actuator control assembly (1) is performed by way of rotary cam-drive devices (5), each one assigned to one operating half-bar (2) and wherein the points-setting device (3) is a device independent of the points-operating half-bar (2) and controlled by the actuator control assembly (1). The invention applies more particularly to the field of railway (railroad) infrastructure, particularly the operating of switch points.

14 Claims, 3 Drawing Sheets

MECHANISM FOR OPERATING SWITCH POINTS

The present invention relates to the area of railroad infrastructure, particularly the operating of point switching units, and has as its object a mechanism for operating point switches.

In general terms, the operating of the point switches of a point switching unit is carried out by means of a mechanism comprising a motor for the entrainment of a control block actuating the point switches through a displacement towards the right or towards the left.

At the present time, the existing mechanisms have either a motor of the hydraulic type or of the mechanical actuator type, or a motor reducer assembly with a rod handle and a cam, or an endless screw and nut, with this motor or motor reducer assembly actuating a control bar composed of two half-bars by means of the control block, and carrying out the translation and the locking of the point switches. This translation and the corresponding locking of the point switches are controlled by means of two other bars, each one assigned to a point switch connected with the same, with the said bars being entrained by the point switches and locking the latter into the service position.

In these known mechanisms, moreover, the control block likewise carries out the locking of the point switches through stabilization with springs, the operation of which is carried out in accordance with the principle of a bi-stable tipping, which has the effect of maintaining the point switches in a position of application against the corresponding counter-point switch rail on an alternating basis. Finally, these mechanisms likewise most frequently include a manual control that allows a direct action on the control and locking block.

These existing mechanisms generally make it possible to carry out a correct and reliable operation of the point switches.

The present invention has as its objective that of eliminating these disadvantages by proposing a mechanism for the operation of point switches, making it possible to ensure the operation and the locking of the point switches simultaneously and independently.

For this purpose, the invention has as its object a mechanism for the operation of point switches comprising a control assembly with an actuator actuating two half-bars for the operation of the point switches, each one connected with a point switch by means of a device for the locking of the point switches and by means of a manual control connected with the actuator control assembly, characterized in that, the actuation of the two half-bars for the operation of the point switches by the actuator control assembly is carried out by means of rotational entrainment devices with cams, each one assigned to an operating half-bar, and in that, the device for locking the point switches is a device independent of the half-bars for the operation of the point switches and is controlled by the actuator control assembly.

The invention will be better understood by means of the description in the following, which relates to one preferred mode of implementation, which is presented by way of a non-limiting example and is explained with reference to the appended schematic diagrams, in which.

Figure 1:
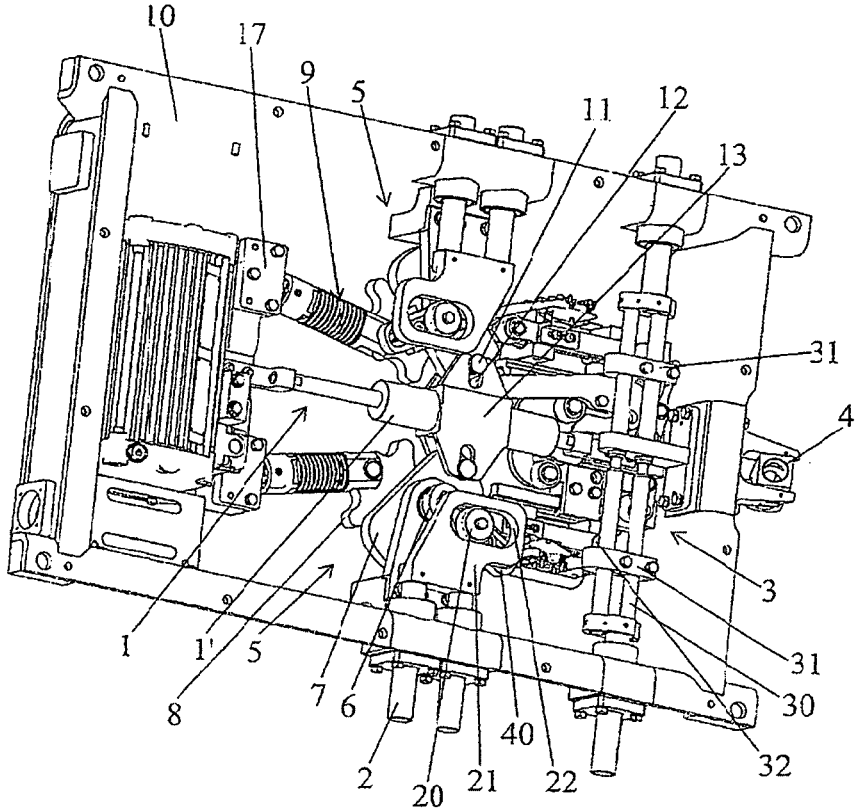
FIG. 1 is a perspective view of the operating mechanism in accordance with the invention.

FIG. 1 of the appended diagrams depicts a mechanism for operating point switches comprising one actuator control assembly 1 that actuates two half-bars 2 for the operation of the point switches (not depicted), each one connected with one point switch by way of a device 3 for locking the point switches and by way of a manual control 4 connected with the assembly 1 for actuator control.

In accordance with the invention, the actuation of the two half-bars 2 for the operation of the point switches by the assembly 1 for actuator control is carried out by means of rotational devices for entrainment with cams 5, each assigned to an operating half-bar 2, and the device 3 for locking the point switches is a device independent of the half-bars 2 for the operation of the point switches and is controlled by the assembly for actuator control 1.

Every rotational device for entrainment with cams 5 that is assigned to an operating half-bar 2 includes the placement on a vertical shaft 6 of a first cam disk 7 cooperating with the assembly 1 for actuator control and a device 3 for locking the point switches for locking the latter in position by means of a second cam disk 8 cooperating with the first cam disk 7, and with the device 3 for locking the point switches, for release of the said point switches from locking in position by a means for stabilization with a spring 9 that acts, at one end, on the second cam disk 8, and is mounted by means of pivoting in the casing 10 for the accommodation of the mechanism, and by a lever 40 for the control of the half-bar 2 for the operation of the point switch, which is likewise secured in rotation with the vertical shaft 6.

As depicted in the appended diagrams, the devices for entrainment 5 are identical and are mounted symmetrically to the longitudinal axis of the actuator control assembly 1, in order to carry out the displacement and locking towards the right or towards the left and the positioning of the point switches in a perfectly synchronous manner.

The first cam disk 7 is mounted in a freely rotatable manner on the vertical shaft 6 and cooperates, on the one hand, with the actuator control assembly 1 by way of a first entrainment rod 11 engaged in a corresponding entrainment groove 12 of an integrally formed slide unit 13 of the actuator 1' of the assembly 1, and, on the other hand, with the second cam disk 8, by means of a second entrainment rod 14 integrally formed with the first cam disk 7 and engaging in a correspondingly curvilinear groove 15 of the second cam disk 8. Thus, the first cam disk 7, which is brought into rotation by the slide unit 13 of the actuator 1' of the assembly 1 during the displacement of the latter into translation, entrains every other cam disk 8 into rotation and, by this means, the vertical shaft 6 integrally formed to this second cam disk 8 is engaged with the curvilinear groove 15 by means of the second entrainment rod 14.

The means for stabilization with spring 9 is provided on its end acting on the second cam disk 8 with an axis of entrainment 16 traversing a corresponding support bearing of the said second cam disk 8, with its opposite end being mounted by means of pivoting in a support bearing 17 of the casing 10. One such means of stabilization with spring operates in accordance with the principle of a knuckle joint; that is to say, it has two extreme stable positions in which it holds the second cam disk 8.

The lever 40 for control of the half-bar 2 for the operation of the point switch, which is secured in rotation with the vertical shaft 6, is mounted on the latter at one end and is provided, in the direction of its opposite end, with an oblong groove 18 for the accommodation of a support 19 of a roller 20 which is adjustable in its position. The roller 20 cooperates with an end plate 21 of the half-bar 2 for the operation of the point switch by means of an oblong guidance unit 22 of the said plate 21, which extends perpendicularly to the longitudinal axis of the half-bar 2. Thus, during the rotation of the vertical shaft 6, the lever 40 for the control of the half-bar 2 for the operation of the point switch is entrained in the same direction of rotation by the said shaft 6, and its roller 20, which is accommodated in the oblong guidance unit 22 of the plate 21, entrains the latter into a translation movement following the longitudinal axis of the half-bar 2, which has as its effect a corresponding displacement of the latter and, therefore, of the point switch as well, and is connected with the same. Because of the possibility of adjustment of the position of the roller 20, the path of the point switch to be operated can be adjusted easily.

The device 3 for locking the point switches is formed by two independent assemblies, each one assigned to one point switch and each composed of at least one half-bar 30 which is connected, at one end, with the corresponding point switch guided into the casing 10 and provided, at its other end, with an abutment unit 31 with a wedge block 32 which is intended to cooperate, in a corresponding position of application of the point switch against the rail, with the abutment unit 31, and is secured by means of a slide unit 33 guided into a support 34 fixed in the casing 10 for the accommodation of the mechanism, with this slide unit 33 cooperating, at one end, with the first and the second cam disks 7 and 8 by means of a roller 35 and a locking shaft 36 coaxial with the roller 35, respectively, and, at its other end, with a complementary means for locking 300, with a return spring 38 accommodated in the support 34 applying the slide unit 33 against the said cam disks 7 and 8. The half-bar 30 connected with the corresponding point switch is therefore displaced with the latter in such a manner that its abutment unit 31 is displaced in the same direction, and may be wedged in the position of application of the point switch against the corresponding rail, as will be described further below.

In accordance with one other characteristic of the invention, the second cam disk 8 is advantageously provided, on its section oriented towards the locking shaft 36 of the slide unit 33, with an accommodation 8' for locking the coaxial locking shaft 36 in the blocking position of the half-bar 30 through the support of the wedge block 32 against the corresponding surface of the abutment unit 31, while the corresponding point switch is applied against the rail. In addition, the first cam disk 7 is provided on its section with two identical cams 7', which are arranged symmetrically in relation to the radius passing through the axis of the second entrainment rod 14 and are intended to cooperate with the roller 35 of the slide unit 33 for the release of the coaxial locking shaft 36 outside the accommodation 8' before a locking operation or the release of the locking.

In accordance with another characteristic of the invention, in the extreme service position corresponding to a locking of the point switch into position with the support of the abutment unit 31 of the half-bar 30 against the wedge block 32 of the slide unit 33, the second entrainment rod 14 of the first cam disk 7 is positioned in the curvilinear groove 15 of the second cam disk 8 with one end of the latter, in such a manner that the beginning of the rotational movement of the first cam disk 7 is carried out without entrainment of the second cam disk 8, with the second entrainment rod 14 being displaced into the curvilinear groove 15.

Thus, during a displacement of the slide unit 13 of the actuator 1' of the assembly 1, the roller 35 of the slide unit 33 is, from the beginning of the rotation of the first cam disk 7, acted upon by the cam 7' of the latter, and is displaced against the action of the return spring 38 of the slide unit 33. Because the coaxial shaft 36 assigned to the second cam disk 8 is aligned axially with the roller 35, and is therefore integrally formed for the translation of the latter, this initial displacement has the effect of extracting the said coaxial locking shaft 36 from the accommodation 8' of the second cam disk 8 during the single rotation of the first cam disk 7, during which the second branch of entrainment 14 is displaced into the curvilinear groove 15. When this rod 14 arrives at the opposite end of the curvilinear groove 15, the second cam disk 8 is entrained into rotation, and the means of stabilization with the spring 9 is simultaneously acted upon by the said cam disk 8.

The spring constituting the means 9 is thus immediately compressed during an initial displacement, during which it pivots in the support bearing 17 of the casing 10 until reaching the point of unstable equilibrium, from which point it pivots in the opposite direction, entraining the second cam disk 8. Following this second pivoting, the second cam disk 8 turns faster than the first cam disk 7, its entrainment no longer being carried out by the second entrainment rod 14 of the first cam disk 7, with this being under the effect of the spring of the means 9, and the second entrainment rod 14 moves without constraint in the curvilinear groove 15, while the second cam disk 8 is tipped into the position of release of the coaxial locking shaft 36 in the accommodation 8' (device of locking 3 of the lower part of FIG. 2). These positions are shown, in particular, in FIG. 2 of the appended diagrams, but also in FIG. 3, in which the arrangement of the locking device 3 and of the means of stabilization with spring 9 are simply depicted in a reverse manner in relation to FIG. 2.

In accordance with another characteristic of the invention, the complementary locking means 300 of the device 3 for locking the point switches consists, in the case of each independent assembly assigned to one point switch, of a lever 301 mounted in a pivoting manner in the casing 10 of the mechanism and actuated by means of a rod 302 mounted in a pivoting manner, at the end opposite to this, in connection with the lever 301 on a sliding element 303 directed into displacement in parallel with the longitudinal axis of the actuator 1' of the actuator control assembly 1 on a support of the guidance unit 304 secured with the support 34 of the guidance unit of the slide unit 33 and, in one means 305 of entrainment for the displacement of the sliding element 303 integrally formed with the actuator 1' of the actuator control assembly 1, with the lever 301 being applied into the extreme positions of operation of the point switches, with its free end on the slide unit 33, at the end opposite to the one supporting the roller 35 and the coaxial locking shaft 36.

Figure 2:
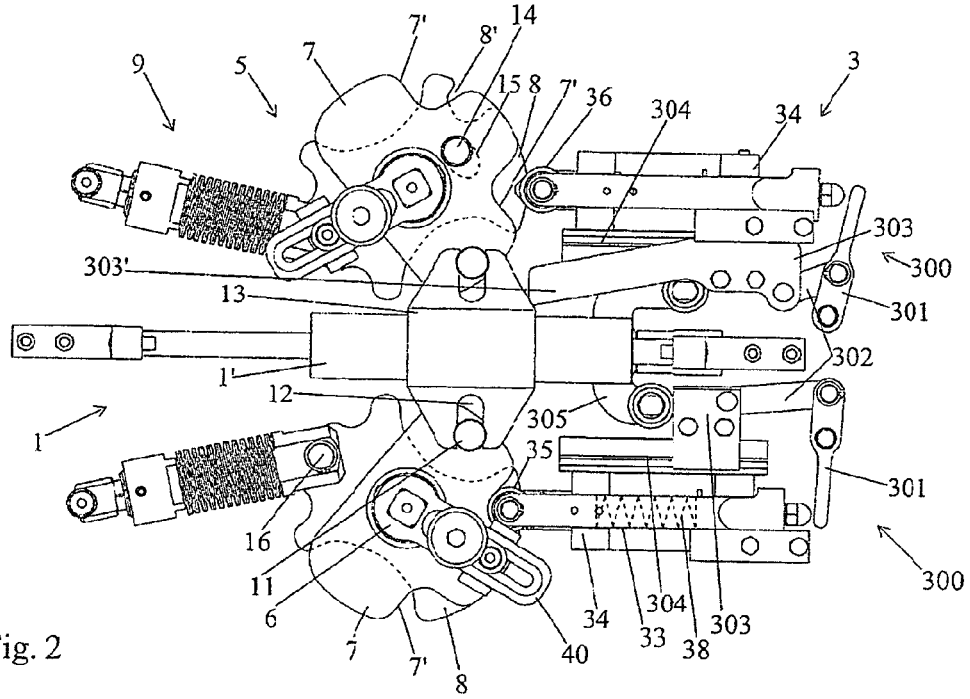
FIG. 2 is a view from above, on a larger scale, of the actuator control assembly, of the rotational devices for entraining the half-bars for operation, and of the device for the locking of the point switches.
Figure 3:
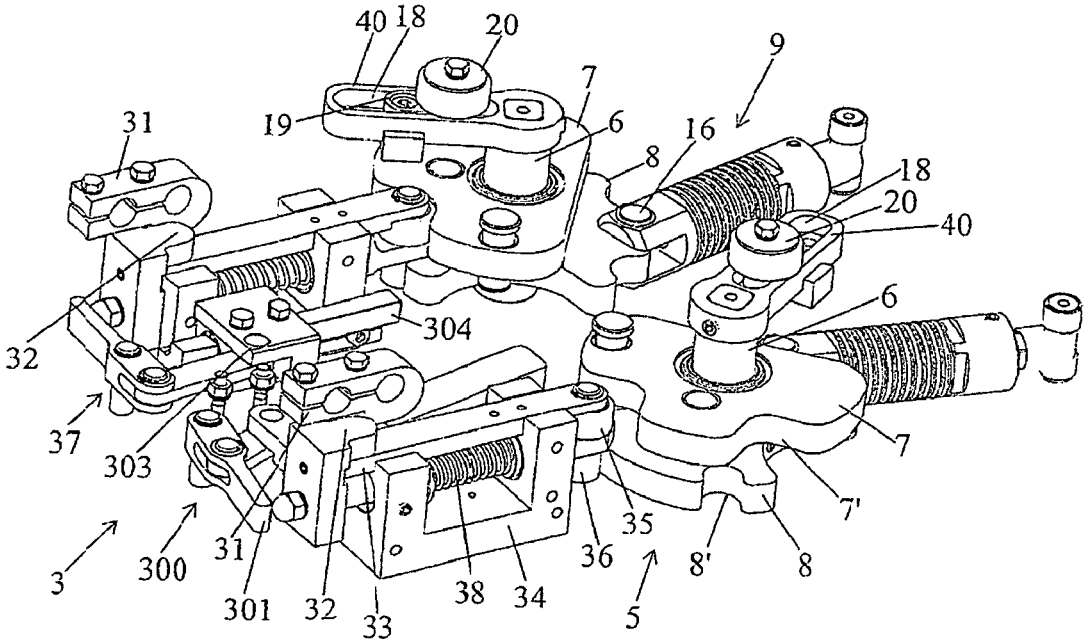
FIG. 3 is a perspective view, likewise on a larger scale, depicting the rotational devices for the entrainment of the half-bars for operation.

As appears in FIGS. 2 and 3 of the appended diagrams, the complementary locking means of every independent assembly is formed by elements with identical functions, but with a different structure for some of them.

Thus, in accordance with one characteristic of the invention, in one of the assemblies of the complementary locking means 300, the lever 301 is, within the casing 10, articulated with an axis traversing it at a distance from its two ends, with the rod 302 being articulated with the said lever 301 at its ends opposite to the one intended to actuate the slide unit 33, while the sliding element 303 is provided with the form of a simple slide unit, against which the integrally formed means of entrainment 305 of the actuator 1' of the actuator control assembly 1 is supported for locking into the service position of the slide unit 33, with the displacement of the said sliding element 303 in the reverse direction being simply carried out following the tipping of the lever 301 under the effect of the displacement of the slide unit 33, while the means of entrainment 305 is released from its support on the said sliding element 303. This mode of implementation corresponds to the one depicted in the lower portion of FIG. 2, and to the upper portion of FIG. 3.

In the other assembly of the complementary locking means 300, the lever 301 is, within the casing 10, articulated with an axis traversing it at one end, with the rod 302 being articulated with the said lever 301 at a distance from its two ends, while the sliding element 303, which has the form of a slide unit and is provided with a curved entraining device 303' cooperating in shape with the integrally formed means of entrainment 305 of the actuator 1' of the actuator control assembly 1 for its displacement towards an unlocking position of the slide unit 33 (depicted in FIGS. 2 and 3), or towards a locking position of the said slide unit 33.

Preferably, the integrally formed means of entrainment 305 of the actuator 1' of the actuator control assembly 1 is composed of two identical rollers mounted on each side of the actuator 1' in parallel to its longitudinal axis, and with a displacement between them in the direction of the longitudinal axis (see FIGS. 1 and 2 of the appended diagrams). Upon considering FIG. 2, it is evident that, in regard to the complementary locking means 300 depicted in the upper portion of FIG. 2, the actuation of the lever 301 is carried out directly in the same direction as the displacement of the actuator 1' and the means of entrainment 305.

This complementary locking means 300 makes it possible to obtain a complementary security in regard to the locking of the point switches in the service position, because it ensures the positioning of the coaxial locking shaft 36 in the accommodation 8', even in the event that the return spring 38 provided for the slide unit 33 is deteriorated or even destroyed for reason of fatigue or another mechanical incident.

The mechanism in accordance with the invention operates in the following manner:

During the actuation of the actuator 1' of the actuator control assembly 1, the integrally formed slide unit 13 of the actuator 1' entrains the first entrainment rod 11 of the first cam disk 7 by means of its entrainment grooves 12. On the first occasion, only the cam disk 7 rotates on the vertical shaft 6, with its second entrainment rod 14 being displaced freely in the curvilinear groove 15 of the second cam disk 8. As has already been explained above, during this initial displacement, the cam 7' of the first cam disk 7, which is located on the surface of the roller 35 of the slide unit 33, displaces the said roller 35 against the action of the return spring 38 of the slide unit 33 in the direction of release of the coaxial locking shaft 36, outside of the accommodation 8' of the second cam disk 8.

Through this displacement of the slide unit 33, the corresponding wedge block 32 is released outside the resulting course of the abutment unit 31 mounted on the half-bar 30 assigned to the corresponding point switch in such a manner that the displacement of this half-bar 30 is rendered possible. During this initial phase, the second entrainment rod 14 of the first cam disk 7 is displaced within the curvilinear groove 15 of the second cam disk 8 without entraining the latter, in such a way that the point switches remain set.

When the second entrainment rod 14 arrives at the end of the free course in the curvilinear groove 15, that is to say, when it enters into abutment with the end of this groove, the second cam disk 8 is entrained into rotation along with the vertical shaft 6, which then entrains the control lever 40 of the half-bar 2 for the operation of the point switch into rotation, and displaces the latter towards its closed position or towards its open position.

When, during the course of this rotation, the means of stabilization with spring 9 passes beyond its position of unstable equilibrium, it brings about a displacement of the second cam disk 8 into rapid rotation, which thus brings the first cam disk 7 into rotation because of the cooperation of the second entrainment rod 14 of the said first disk 7 with the curvilinear groove 15 of the second disk 8. This rapid rotation entrains the closing of one of the point switches through contact with the corresponding counter-point switch rail, as well as the corresponding displacement of the corresponding half-bar 30 of the device of locking 3. In addition, the second disk 8 is displaced into the position of engagement of the coaxial locking shaft 36 in the accommodation 8', which has the effect that the slide unit supporting it carries out a displacement in such manner that it positions the wedge block 32 with which it is provided behind the abutment unit 31, which is provided for the corresponding half-bar 30 of the point switch applied against the counter-point switch rail, and thus prevents any displacement of the said half-bar in the reverse direction.

During the final resulting displacement of the actuator 1' of the actuator control assembly 1, the first cam disk 7 entrains the second cam disk 8 up to the perfect correspondence of the coaxial locking shaft 36 with the base of the accommodation 8', and the integrally formed means of entrainment 305 of the actuator 1' of the actuator control assembly 1 entrains the sliding element 303 in the direction of displacement of the lever 301, thus permitting the locking into position of the slide unit 33, the coaxial locking shaft 36 of which is positioned in the accommodation 8' of the first cam disk 8.

By means of the invention, it is possible to construct a mechanism for the operation of point switches in which all of the displacements for the actuation of the control half-bars of the point switches are carried out by means of rotation or by means of rolling, with all of the internal movements of the mechanisms being additionally independent of the course of the point switches. The latter is adjusted during the final stage, when they are the closest to the point switches, which consequently reduces the influence of the internal clearance, particularly from fatigue, over a long period of time.

In addition, the mechanism in accordance with the invention has a nearly total symmetry of construction, thereby allowing its use for the operation and locking of every point switch, as well as a maximum of identical parts, which reduces the costs of manufacturing and facilitates maintenance. In regard to the latter, the access to the mechanism is therefore additionally facilitated, and all the parts constituting the latter are perfectly accessible visually to maintenance personnel, with no layer of functional elements being inaccessible.

Of course, the invention is not limited to the mode of implementation described and depicted in the appended diagrams. Some modifications remain possible, particularly in regard to the composition of the various elements or the substitution of technical equivalents, without thereby moving beyond the area of protection of the invention.

The invention claimed is:

1. A mechanism for operating point switches, comprising: an actuator control assembly (1) which actuates two half-bars (2) for operating the point switches, each one of the two half-bars connected with one point switch by means of a device (3) for locking the point switches and by means of a manual control (4) connected with the actuator control assembly (1), characterized in that, the actuation of the two half-bars (2) for the operation of the point switches by the actuator control assembly (1) is carried out by means of rotational entrainment devices with cams (5), each one being assigned to a half-bar for operating (2), and comprising the placement of a first cam disk (7) on a vertical shaft (6), the cam disk (7) cooperates with the actuator control assembly (1) and with the device (3) for locking the point switches into position, and a second cam disk (8) cooperating with the first cam disk (7) and with the device (3) for locking the point switches for the release of the said point switches from locking into position, and a means for stabilization having a spring (9) which is coupled, on a first end, to the second cam disk (8) and is mounted, on a second end, in a pivoting manner to the casing (10), and a lever (40) for the control of the half-bar (2) for the operation of the point switch, which is likewise brought into rotation with the vertical shaft (6).

2. A mechanism in accordance with claim 1, characterized in that, the devices for entrainment (5) are identical and are mounted symmetrically with the longitudinal axis of the actuator control assembly (1).

3. A mechanism in accordance with claim 1, characterized in that, the first cam disk (7) is mounted in free rotation on the vertical shaft (6) and cooperates, on the one hand, with the actuator control assembly (1) by means of a first entrainment rod (11) engaged in a corresponding entrainment groove (12) of an integrally formed slide unit (13) of the actuator (1') of the actuator control assembly (1) and, on the other hand, with the second cam disk (8), by means of a second entrainment rod (14) integrally formed with the same first cam disk (7) and engaging in a corresponding curvilinear groove (15) of the said second cam disk (8).

4. A mechanism in accordance with claim 1, characterized in that, the means of stabilization with spring (9) is provided on the first end which acting on the second cam disk (8) with an axis of entrainment (16) traversing a corresponding support bearing of the said second cam disk (8), with its opposite end being mounted in a pivoting manner in a support bearing (17) of the casing (10).

5. A mechanism in accordance with claim 1, characterized in that, the lever (40) for control of the half-bar (2) for the operation of the point switch, which is brought into rotation with the vertical shaft (6), is mounted on the latter at one end and is provided, in the direction of its opposite end, with an oblong groove (18) for the accommodation of a support (19) of a roller (20) which is adjustable in position.

6. A mechanism in accordance with claim 1, characterized in that, the roller (20) cooperates with an end plate (21) of the half-bar (2) for the operation of the point switch by means of an oblong guidance unit (22) of the said plate (21) extending perpendicularly to a longitudinal axis of the half-bar (2).

7. A mechanism in accordance with claim 1, characterized in that, the device (3) for locking the point switches, which is controlled by the actuator control assembly (1), is formed by two independent assemblies, each one assigned to a point switch and each one composed of at least one half-bar (30) connected at one end with the corresponding point switch which is guided into the casing (10) and is provided, at its one end, with an abutment unit (31), with a wedge block (32) which is intended to cooperate, in the position of application of the corresponding point switch against the rail, with the abutment unit (31) and is secured with a slide unit (33) guided into a support (34) fixed in the casing (10) for the accommodation of the mechanism, with the slide unit (33) cooperating, at one end, with the first and second cam disks (7 and 8), by means of a roller (35) and a locking shaft (36) coaxial to the roller (35), respectively, and, at its other end, with a complementary locking means (300), with a return spring (38) accommodated in the support (34) applying the slide unit (33) against the said cam disks (7 and 8).

8. A mechanism in accordance with claim 1, characterized in that, the second cam disk (8) is provided, in its section oriented towards the coaxial locking shaft (36) of the slide unit (33), with an accommodation (8') for locking the coaxial locking shaft (36) in the blocking position of the half-bar (30) through the support of the wedge block (32) against the corresponding surface of the abutment unit (31) when the corresponding point switch is applied against the rail.

9. A mechanism in accordance with claim 1, characterized in that, the first cam disk (7) is provided on its edge with two identical cams (7') which are positioned symmetrically in relation to the radius passing through the axis of the second entrainment rod (14) and are intended to cooperate with the roller (35) of the slide unit (33) for the release of the coaxial locking shaft (36) outside the accommodation (8') before an operation of locking or the reversal of the locking.

10. A mechanism in accordance with claim 1, characterized in that, in the extreme service position corresponding to a locking in the position of the point switch through the support of the abutment unit (31) of the half-bar (30) against the wedge block (32) of the slide unit (33), the second entrainment rod (14) of the first cam disk (7) is positioned in the curvilinear groove (15) of the second disk with cam (8) at one end of the latter in such a manner that the beginning of the movement of rotation of the first cam disk (7) is carried out without the entrainment of the second cam disk (8), with the second entrainment rod (14) being displaced into the curvilinear groove (15).

11. A mechanism in accordance with claim 1, characterized in that, the complementary locking means (300) of the device (3) for locking the point switches consists, for each independent assembly assigned to one point switch, of a lever (301) mounted in a pivoting manner in the casing (10) of the mechanism and actuated by means of a rod (302) mounted in a pivoting manner on the end opposite to the one in connection with the lever (301), on a sliding element (303) moved into displacement in parallel with the longitudinal axis of the actuator (1') of the actuator control assembly (1), on a guiding support (304) secured with the support (34) for guiding the slide unit (33), and of a means (305) for entrainment of the sliding element (303) into displacement, which is integrally formed with the actuator (1') of the actuator control assembly (1), with the lever (301) being applied in the extreme positions of operation of the point switches, with its free end on the slide unit (33), on the end opposite to the one supporting the roller (35) and the coaxial locking shaft (36).

12. A mechanism in accordance with claim 11, characterized in that, for one of the assemblies of the complementary locking means (300), the lever (301) is articulated in the casing (10) with an axis traversing it at a distance from its two ends, with the rod (302) being articulated with the said lever (301), on its end opposite to the one intended to actuate the slide unit (33), while the sliding element (303), which is present in the form of a simple slide unit, against which the integrally formed means of entrainment (305) of the actuator [1'] of the actuator control assembly (1), is supported for the locking of the slide unit (33) into the service position, with the displacement of the said sliding element (303) in the reverse direction being simply carried out following the tipping of the lever (301) under the effect of the displacement of the slide unit (33), while the means of entrainment (305) is released from its support on the said sliding element (303).

13. A mechanism in accordance with claim 11, characterized in that, in the other assembly of the complementary locking means (300), the lever (301) is articulated in the casing (10) with an axis traversing it at one end, with the rod (302) being articulated on the said lever (301) at a distance from its two ends, while the sliding element (303) is present in the form of a slide unit provided with a curved entraining unit (303') cooperating in form with the integrally formed means of entrainment (305) of the actuator (1') of the actuator control assembly (1) for its displacement either towards the position of unlocking of the slide unit (33) or towards a position of locking of the said slide unit (33).

14. A mechanism in accordance with claim 11, characterized in that, the integrally formed means of entrainment (305) of the actuator (1') of the actuator control assembly (1) is composed of two identical rollers mounted on each side of the actuator (1') in parallel with its longitudinal axis and with a displacement between them in the direction of the longitudinal axis.

* * * * *